US006935731B2

(12) United States Patent
Wirth et al.

(10) Patent No.: US 6,935,731 B2
(45) Date of Patent: Aug. 30, 2005

(54) INK JET PRINT SYSTEM INCLUDING PRINT CARTRIDGE

(75) Inventors: Steven J. Wirth, Escondido, CA (US); Yichuan Pan, San Diego, CA (US); Dennis J. Astroth, Encinitas, CA (US)

(73) Assignee: Eastman Kodak Company, Rochester, NY (US)

( * ) Notice: Subject to any disclaimer, the term of this patent is extended or adjusted under 35 U.S.C. 154(b) by 14 days.

(21) Appl. No.: 10/659,576

(22) Filed: Sep. 10, 2003

(65) Prior Publication Data

US 2005/0052508 A1 Mar. 10, 2005

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS

| | | | | |
|---|---|---|---|---|
| 4,967,207 | A | 10/1990 | Ruder | |
| 5,250,957 | A * | 10/1993 | Onozato | 347/7 |
| 5,754,207 | A * | 5/1998 | Gragg et al. | 347/86 |
| 5,874,976 | A | 2/1999 | Katon et al. | |
| 5,971,532 | A | 10/1999 | Toda | |
| 5,980,032 | A | 11/1999 | Pawlowski, Jr. et al. | |
| 6,364,458 | B2 * | 4/2002 | Eckard et al. | 347/49 |
| 6,382,784 | B2 * | 5/2002 | Pawlowski et al. | 347/85 |
| 6,481,829 | B1 * | 11/2002 | Bailey et al. | 347/49 |
| 6,550,894 | B2 * | 4/2003 | Ueno et al. | 347/49 |
| 6,863,388 | B2 * | 3/2005 | Seino et al. | 347/86 |

FOREIGN PATENT DOCUMENTS

| | | |
|---|---|---|
| EP | 0 322 131 A1 | 6/1989 |
| EP | 0 676 293 A1 | 10/1995 |
| EP | 0 899 111 A2 | 3/1999 |
| EP | 1 055 520 A1 | 11/2000 |
| JP | 05-096744 | 4/1993 |
| WO | WO 97/42035 | 11/1997 |

OTHER PUBLICATIONS

Patent Abstracts of Japan, Title: Apparatus of and Method for Injecting Ink, Application: Canon, Inventor: Watabe Shunichi, Publication No. 11216876, Publication Date: Oct. 08, 1999.

* cited by examiner

*Primary Examiner*—Anh T. N. Vo
(74) *Attorney, Agent, or Firm*—Roger A. Fields

(57) ABSTRACT

An ink jet printer apparatus is adapted to secure a print cartridge which includes an open container having a top opening; a porous ink-absorbent in the container; a print head in ink communication with the porous ink-absorbent; a top cover lid adapted to be placed on the container, over the top opening, to close the container; and an ink conduit needle mounted on the top cover lid to longitudinally extend in a horizontal orientation above the porous ink-absorbent when the cover lid is placed on the container, so that a print ink can descend freely by the force of gravity from the ink conduit needle onto the porous ink-absorbent and from the porous ink-absorbent down to the print head. The ink jet printer apparatus has a resilient septum; an ink delivery connection to the septum; a stall for receiving the print cartridge in a substantially horizontal direction, so that the ink conduit needle mounted on the top cover lid is horizontally inserted through the septum; and a cover door movable closed to cover the print cartridge when the print cartridge is received in the stall, and adapted to secure the print cartridge in place within the stall to ensure that the ink conduit needle cannot be dislodged from the septum.

8 Claims, 5 Drawing Sheets

INK JET PRINT SYSTEM INCLUDING PRINT CARTRIDGE

CROSS-REFERENCE TO RELATED APPLICATION

Reference is made to commonly assigned co-pending application Ser. No. 10/659,491 entitled APPARATUS FOR SECURING PRINT CARTRIDGE IN INK JET PRINTER and filed Sep. 9, 2003 in the names of Yichuan Pan et al.

FIELD OF THE INVENTION

The invention generally relates to ink jet printing, and in particular to apparatus for securing a print cartridge in an ink jet printer.

BACKGROUND OF THE INVENTION

Ink jet printers are well known. One common type of ink jet printer uses a replaceable print cartridge that is loaded into a scanning carriage in an ink jet printer. The scanning carriage scans across a paper sheet to print a swath of ink on the sheet, using a print head on the cartridge.

Prior art Japan Application No. 03-285746, filed Oct. 5, 1991 and published Apr. 20, 1993 (Publication No. 05-096744), discloses a print cartridge, which in one embodiment has a porous ink-absorbent, such as a sponge, and a print head in ink communication with the porous ink-absorbent. The print cartridge is refilled with the print ink by vertically lowering an ink supply into a nest in the print cartridge. An ink conduit needle erect at the bottom of the nest vertically pierces a septum at the bottom of the ink supply. This enables the print ink to flow from the ink supply to the porous ink-absorbent via a capillary tube in the print cartridge.

Prior art U.S. Pat. No. 5,980,032 issued Nov. 9, 1999 discloses an ink jet printer including a replaceable print cartridge which is vertically lowered into a stall on the scanning carriage. When the print cartridge is pushed into the stall, an ink conduit needle on the cartridge vertically pierces an upstanding septum on the scanning carriage. This allows a flexible ink delivery tube interconnecting the septum and a stationary ink supply source separate from the scanning carriage to flow the print ink to the print cartridge.

SUMMARY OF THE INVENTION

An ink jet printer apparatus for securing a print cartridge which includes:

an open container having a top opening;

a porous ink-absorbent in the container;

a print head in ink communication with the porous ink-absorbent;

a top cover lid adapted to be placed on the container, over the top opening, to close the container; and an ink conduit needle mounted on the top cover lid to longitudinally extend in a horizontal orientation above the porous ink-absorbent when the cover lid is placed on the container, so that a print ink can descend freely by the force of gravity from the ink conduit needle onto the porous ink-absorbent and from the porous ink-absorbent down to the print head, said apparatus comprising:

a resilient septum;

an ink delivery connection to the septum;

a stall for receiving the print cartridge in a substantially horizontal direction so that the ink conduit needle mounted on the top cover lid is horizontally inserted through or pierces the septum; and a cover door movable closed to cover the print cartridge when the print cartridge is received in the stall, and adapted to secure the print cartridge in place within the stall to ensure that the ink conduit needle cannot be dislodged from the septum.

Preferably, an electrical circuit is located in the stall to connect with a corresponding circuit on the print cartridge. In this instance, the cover door secures the print cartridge in place within the stall to ensure that the corresponding circuit on the print cartridge cannot become separated from the electrical circuit in the stall.

DETAILED DESCRIPTION OF THE INVENTION

The invention is depicted as embodied in an ink jet printer. Because the features of such a printer are generally known, the detailed description which follows is directed only to those elements forming part of or cooperating with the invention. It is to be understood, however, that other elements not described may take various forms known to a person of ordinary skill in the art.

Print Cartridge

Figure 1:
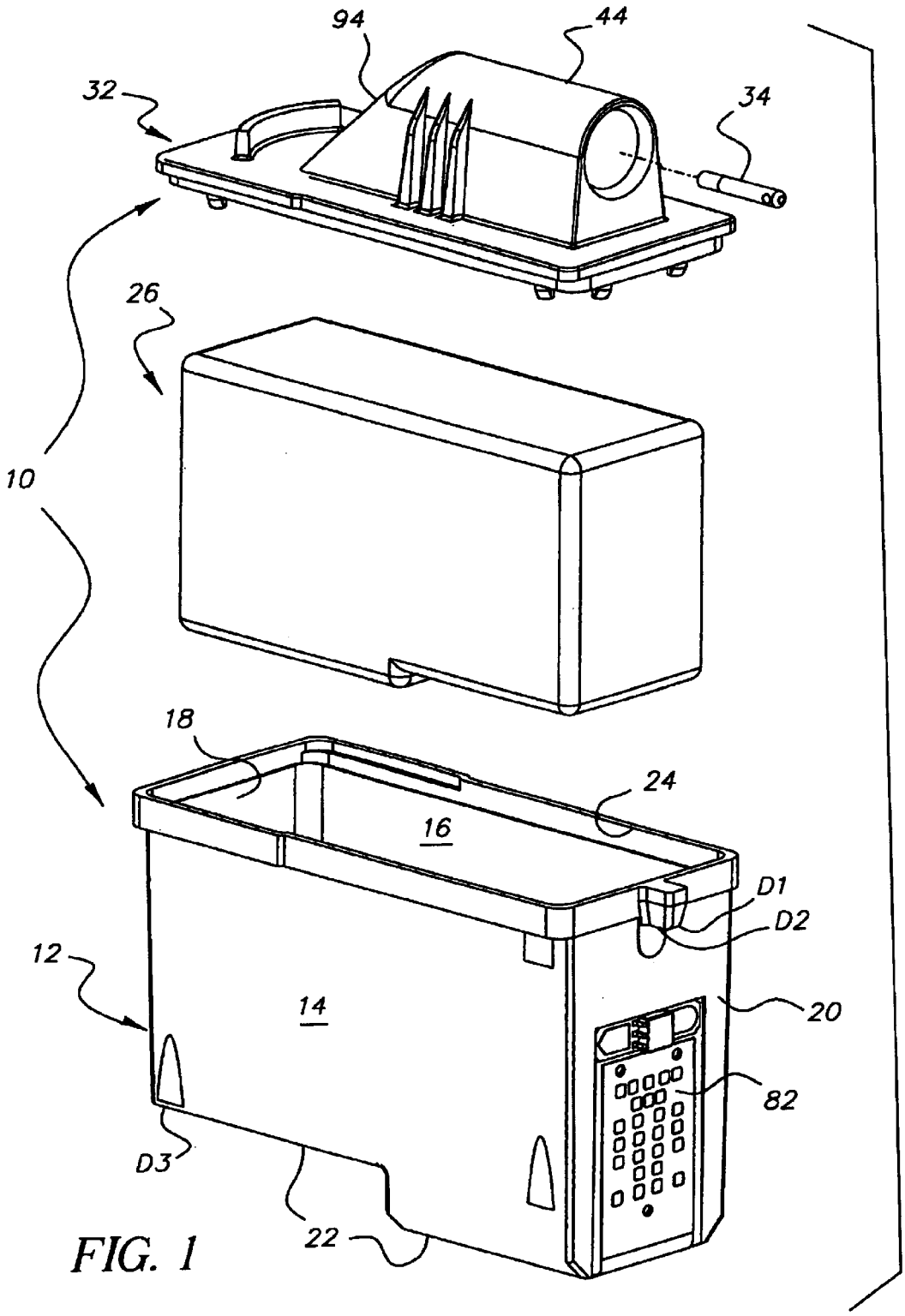
FIG. 1 is an exploded perspective view of a print cartridge.
Figure 2:
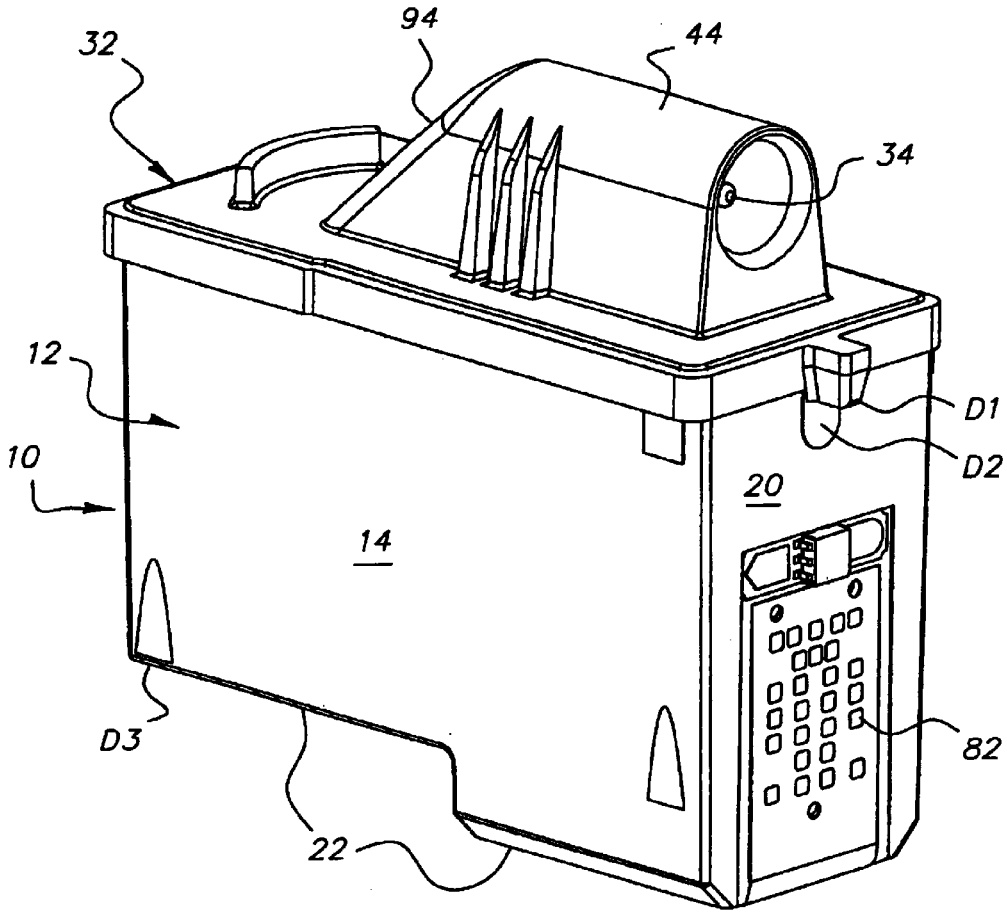
FIG. 2 is an assembled perspective view of the print cartridge.
Figure 5:
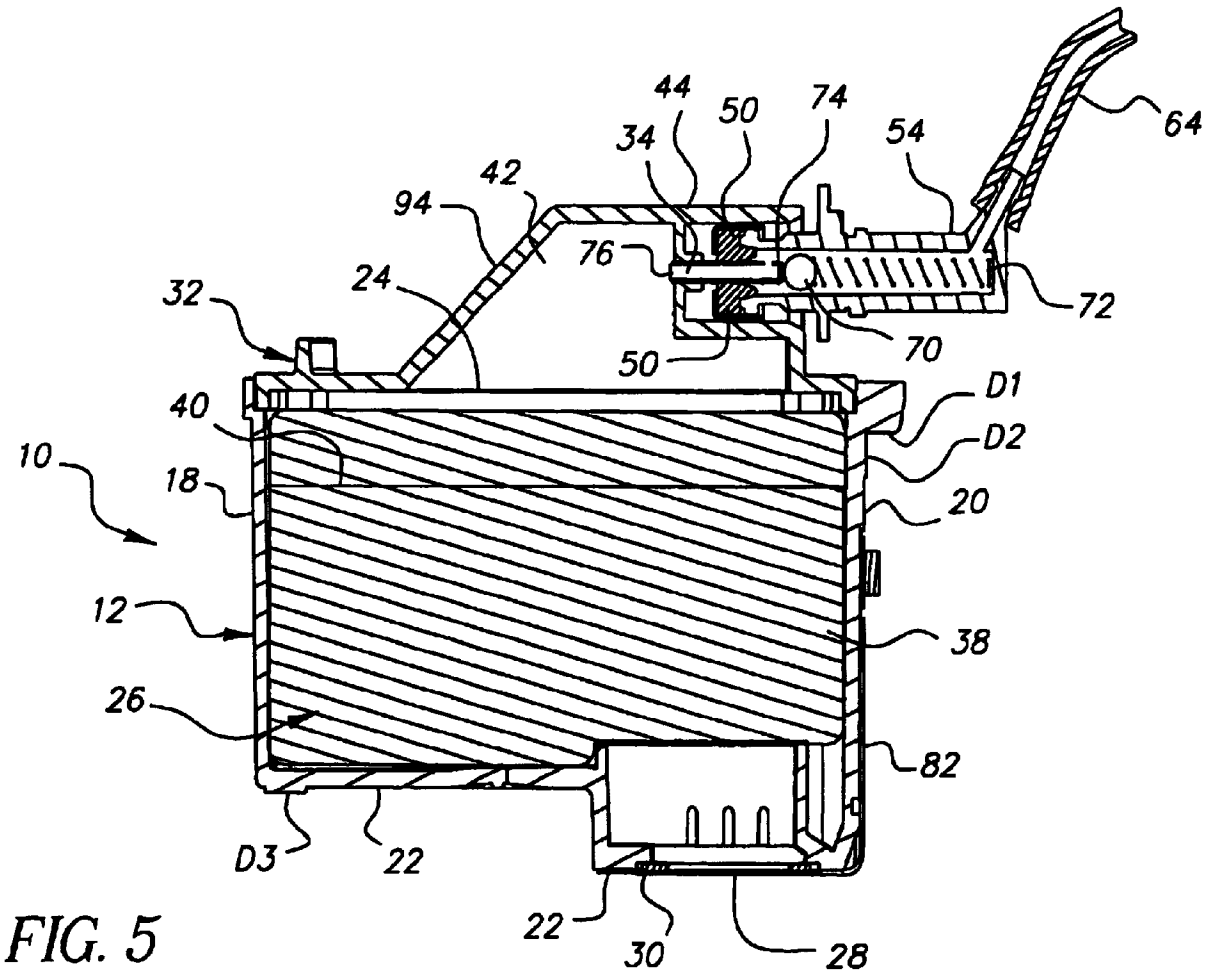
FIG. 5 is a side elevation view in cross-section of the print cartridge and the ink delivery assemblage.

FIGS. 1, 2 and 5 show a print cartridge 10.

A box-like container 12 of the print cartridge 10 has a pair of parallel planar side walls 14 and 16, a pair of parallel planar end walls 18 and 20, and a stepped bottom wall 22. There is no top wall, so that there is a rectangular-shaped top opening 24 as shown in FIG. 1.

A porous ink-absorbent 26, such as a foam or sponge block, is fitted tightly in the container 12 to abut the side, end and bottom walls 14, 16 18, 20 and 22 of the container, and also to be adjacent the top opening 24 of the container, as shown in FIGS. 1 and 5.

A print head 28 at an opening 30 in the bottom wall 22 of the container 12 is in gravity-flow ink communication with the porous ink-absorbent 26 in the container. See FIGS. 1 and 5.

A top cover lid 32 is adapted to be placed on the container 12, over the top opening 24 in the container, to close the container at the top opening. See FIGS. 2 and 5.

A hollow ink conduit needle 34 is mounted in the top cover lid 32 to be positioned spaced above the porous ink-absorbent 26 in the container 12 when the top cover lid is placed on the container as shown in FIG. 5. This allows a print ink 38 to vertically descend freely by the force of gravity from the ink conduit needle 34, through the top opening 24 in the container 12, onto the porous ink-absorbent 26, in order for the print ink to accumulate vertically on the porous ink-absorbent to a maximum ink level 40 as shown in FIG. 5. The ink conduit needle 34 longitudinally extends in a horizontal orientation above the ink absorbent 26 when the top cover lid 32 is on the container 12.

The top cover lid 32 forms an air chamber 42 between the ink conduit needle 34 and the porous ink-absorbent 26 when the top cover lid is on the container 12. See FIG. 5. Also, the top cover lid 32 has an open shroud 44 for the ink conduit needle 34.

Scanning Carriage

A scanning carriage 46 in an ink jet printer is movable along a slide rod 48 to scan across a paper sheet (not shown), in order to print a swath of the print ink 38 on the paper sheet as in prior art U.S. Pat. No. 5,980,032 issued Nov. 9, 1999. See FIG. 3.

Figure 3:
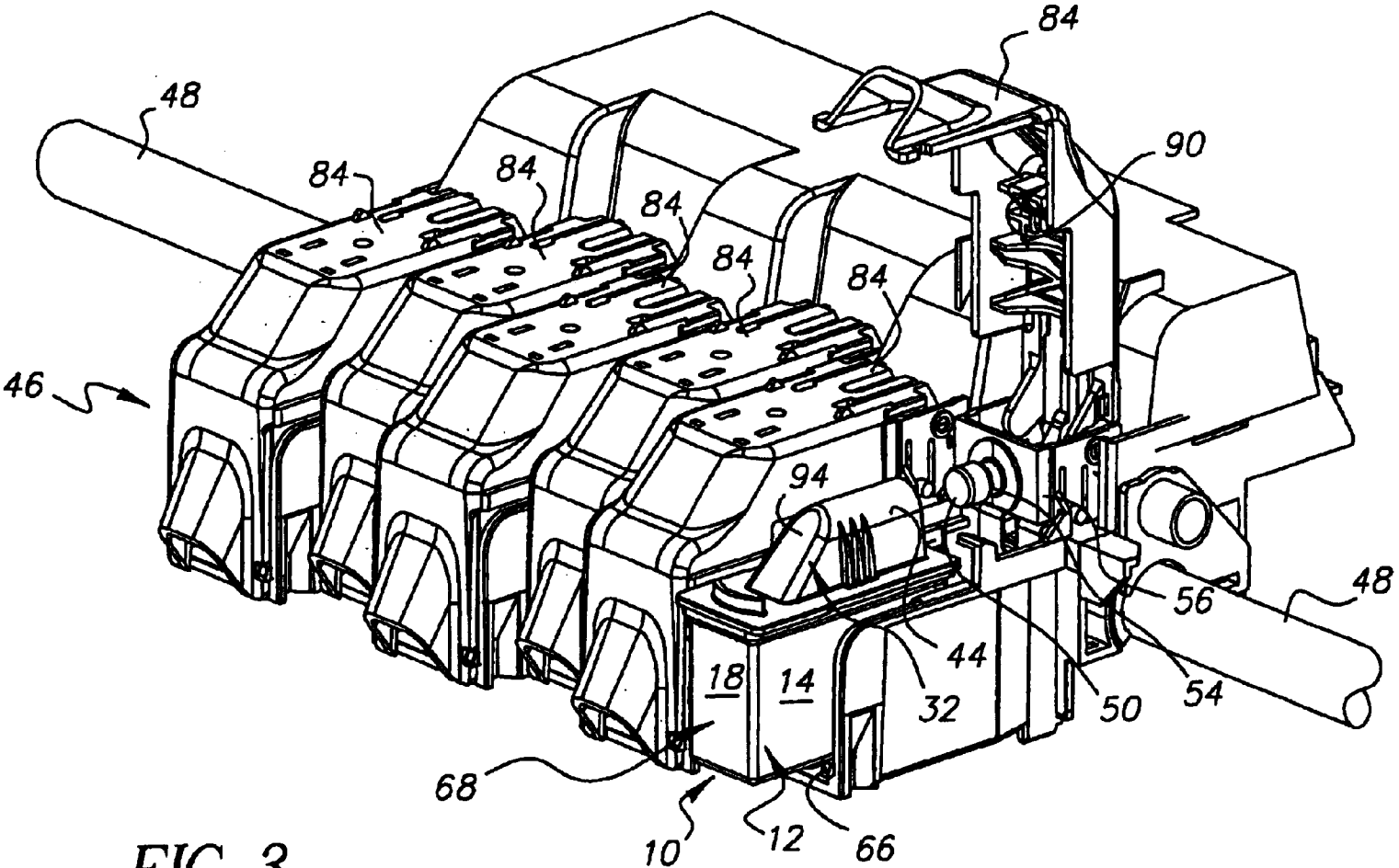
FIG. 3 is a side perspective view of an ink jet printer scanning carriage, including a stall for receiving the print cartridge.
Figure 4:
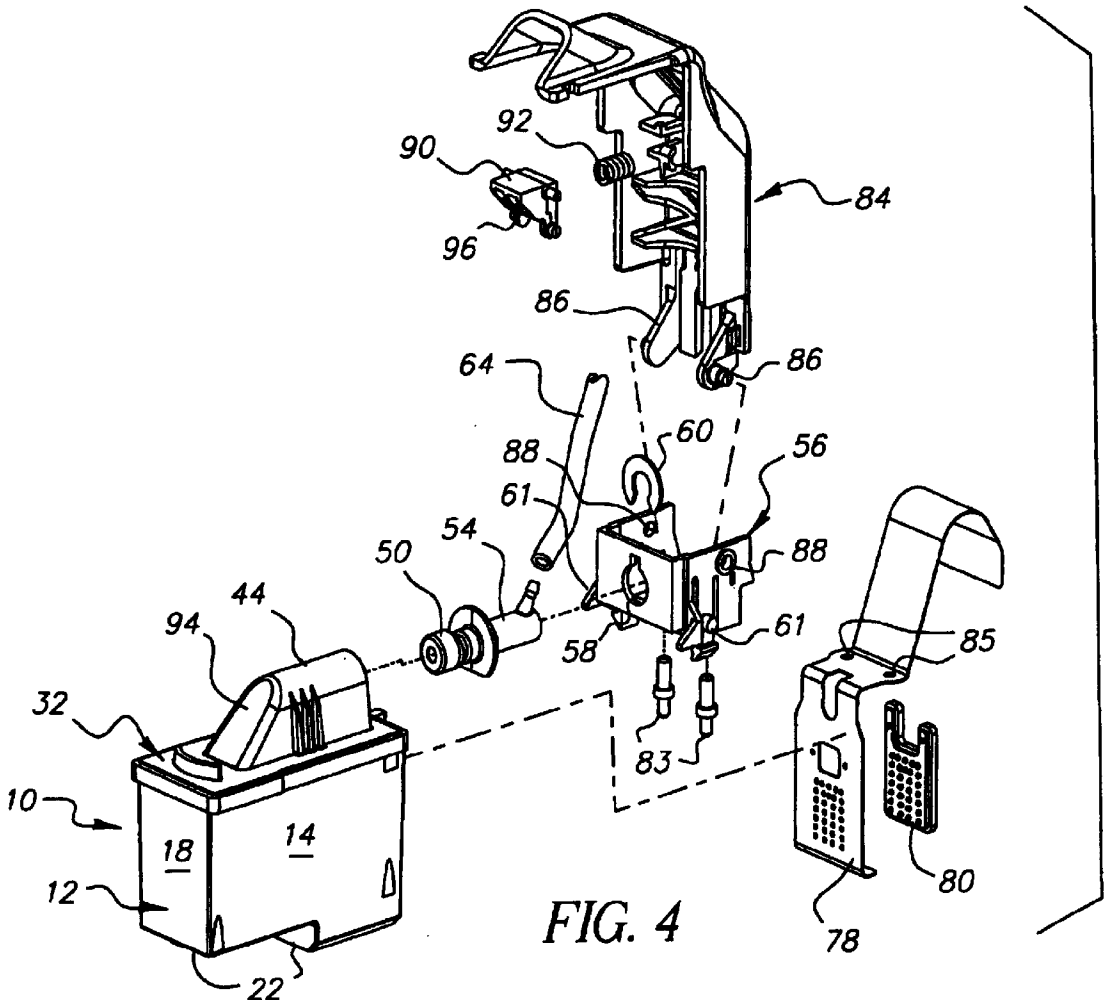
FIG. 4 is an exploded perspective view of an ink delivery assemblage on the scanning carriage for flowing a print ink to the print cartridge from a stationary ink supply source separate from the scanning carriage, and of a cover door that when closed secures the print cartridge in place on the scanning carriage.

The scanning carriage 46 includes a resilient rubber horizontally pierceable septum 50, a rigid tubular or cylindrical support 54 for the septum, and a mounting support or bracket 56 for the tubular support, as shown in FIGS. 3–5. The septum 50 is fixed to the tubular support 54. The tubular support 54 longitudinally extends through a wall hole 58 in the mounting support 56 and is secured to the mounting support via a c-shaped fastener clip 60. See FIG. 4. The mounting support 56 is secured to the scanning carriage 46 by a pair of fastener detents or clips 61, 61 that extend into respective holes (not shown) in the scanning carriage. A flexible ink delivery tube 64 is connected at one end to the tubular support 54 and at another end to a stationary ink reservoir (not shown) which is separate from the scanning carriage 48. A stall 66 on the scanning carriage 48 is configured to receive the print cartridge 10 in a substantially horizontal direction 68, so that the ink conduit needle 34 mounted in the top cover lid 32 of the print cartridge is horizontally inserted through or pierces the septum 50 as shown in FIG. 5. If the horizontal direction 68 is considered to be along an X-axis, the tubular support 54 is fixed along that axis, but may slightly adjust (0.025") along Y- and Z-axis. When the ink conduit needle 34 extends longitudinally through the septum 50 as shown in FIG. 5, it displaces a ball valve 70 against the counter-urging of a ball return spring 72 inside the tubular support 54. The ball valve 70 is displaced from firmly abutting one end of the septum. The septum 50 can have some known means (not shown) to facilitate insertion of the ink conduit needle 34 through the septum 50, such as a pre-pierced cylindrical hole in the septum which has a diameter that is less than the diameter of the needle, or a pre-pierced center slit in the septum, or a leading indentation. It is important that the septum 50 snugly embraces the needle 34 when the needle longitudinally extends through the septum, so that there can be no air between the needle and the septum.

The ink conduit needle 34 has an ink ingress opening 74 and an ink egress opening 76 as shown in FIG. 5, in order for the print ink 38 to flow into and out of the needle and then gravity descend from the ink egress opening, through the top opening 24 in the container 12, onto the porous ink-absorbent 26 in the container. The print ink 38 then drains to the print head 28 at the bottom opening 30 in the bottom wall 22 of the container 12

A flexible (ribbon) electrical circuit 78 supported on a spring pad 80 on the scanning carriage 46 contacts a corresponding circuit 82 on the end wall 20 of the container 12 of the print cartridge 10, when the print cartridge is loaded in the stall 60. See FIG. 4. Preferably, the print cartridge 10 is supported in the stall 60 at (at least) three datum surfaces D1, D2 and D3 on the container 12. See FIG. 5. A pair of pins 83, 83 project at one of their ends through bottom holes (not shown) in the mounting support 56 and project at opposite ends into top holes 85, 85 in the flexible circuit 78.

A cover door 84 has coaxial projections 86, 86 that protrude into respective wall holes 88, 88 in the mounting support 56 to pivotally support the cover door on the mounting support as shown in FIG. 4. When the cover door 84 is pivoted down counter-clockwise in FIG. 3, it closes to firmly hold or secure the print cartridge 10 in the stall 66. The cover door 84 includes a spring-urged cartridge retainer 90 that is pivotally supported on the cover door, such as by coaxial pins in respective slots (not shown), and is urged to pivot counter-clockwise by a helical compression spring 92 in FIG. 4 for this purpose. When the cover door 84 is pivoted closed in FIG. 4, the retainer 90 is brought to bear firmly against an inclined face or surface 94 on the top cover lid 32 of the print cartridge 10. See FIG. 3. This acts to ensure that the ink conduit needle 34 mounted in the top cover lid 32 cannot be dislodged from the septum 50 and that the print cartridge 10 is properly positioned in the stall 66 by being supported at the datum surfaces D1, D2 and D3 on the container 12. Also, it acts to ensure that the flexible circuit 78 supported on the spring pad 80 on the scanning carriage 46 remains in contact with the corresponding circuit 82 on the print cartridge 10. As shown in FIG. 4, the retainer 90 has an inclined face or surface 96 that complements the inclined face 94 on the top cover lid 44.

The invention has been described in detail above, but it will be understood that variations and modifications can be effected within the spirit and scope of the invention as defined in the claims which follow.

Parts List

10. print cartridge
12. container
14. side wall
16. side wall
18. end wall
20. end wall
22. bottom wall
24. top opening
26. porous ink-absorbent
28. print head
30. opening
32. top cover lid
34. ink conduit needle
38. printink
40. maximum ink level
42. air chamber
44. shroud
46. scanning carriage
48. slide rod
50. septum
54. tubular support
56. mounting support
58. wall hole
60. fastener clip
61, 61. fastener detents
64. ink delivery tube
66. stall
68. horizontal direction
70. ball valve
72. ball return spring
74. ink ingress opening
76. ink egress opening

78. electrical circuit
80. spring pad
82. corresponding circuit
D1, D2, D3 datum surfaces
83, 83 pins
84. cover door
85, 85 top holes
86, 86. coaxial projections
88, 88. wall holes
90. cartridge retainer
92. helical compression spring
94. inclined face
96. inclined face

What is claimed is:

1. A print cartridge comprising:

an open container having a top opening;

a porous ink-absorbent in said container;

a print head in ink communication with said porous ink-absorbent;

a cover lid adapted to be placed on said container, over said top opening, to close said container at said top opening; and an ink conduit needle mounted in said cover lid to be positioned spaced above said porous ink-absorbent when said cover lid is placed on said container, so that a print ink can descend freely by the force of gravity from said ink conduit needle onto said porous ink-absorbent in order to accumulate vertically on said porous ink-absorbent.

2. A print cartridge as recited in claim 1, wherein said cover lid forms an air chamber between said ink conduit needle and said porous ink-absorbent when said cover lid is placed on said container.

3. A print cartridge as recited in claim 2, wherein said cover lid has a shroud for said ink conduit needle.

4. A print cartridge as recited in claim 1, wherein said porous ink-absorbent is adjacent said top opening in said container.

5. A print cartridge as recited in claim 4, wherein said print ink that accumulates vertically on said porous ink-absorbent accumulates to a maximum level below said top opening.

6. A print cartridge comprising:

a box-like container having side, end and bottom walls, but no top wall so that there is a top opening;

a porous ink-absorbent fitted in said container to abut said side, end and bottom walls and be adjacent said top opening;

a print head at an opening in said bottom wall and in ink communication with said porous ink-absorbent;

a top cover lid adapted to be placed on said container, over said top opening, to close said container at said top opening; and an ink conduit needle mounted in said cover lid to be positioned spaced above said porous ink-absorbent when said cover lid is placed on said container, so that a print ink can descend freely by the force of gravity from said ink conduit needle, through said top opening, onto said porous ink-absorbent and from the porous ink-absorbent vertically down to the print head.

7. An ink jet print system comprising:

a print cartridge including:

(a) an open container having a top opening;

(b) a porous ink-absorbent in said container;

(c) a print head in ink communication with said porous ink-absorbent;

(d) a cover lid adapted to be placed on said container, over said top opening, to close said container at said top opening; and (e) an ink conduit needle mounted in said cover lid to longitudinally extend in a horizontal orientation above said porous ink-absorbent when said cover lid is placed on said container, so that a print ink can descend freely by the force of gravity from said ink conduit needle onto said porous ink-absorbent in order to accumulate vertically on said porous ink-absorbent; and a movable scanning carriage including:

(a) a resilient septum;

(b) a support for said septum;

(c) a flexible ink delivery tube connected to said septum; and (d) a stall for receiving said print cartridge in a substantially horizontal direction so that said ink conduit needle is horizontally inserted through in said septum.

8. Apparatus for effecting an ink delivery connection with a print cartridge, wherein the print cartridge includes:

an open container having a top opening;

a porous ink-absorbent in the container;

a print head in ink communication with the porous ink-absorbent;

a cover lid adapted to be placed on the container, over the top opening, to close the container; and an ink conduit needle mounted in the cover lid to longitudinally extend in a horizontal orientation above the porous ink-absorbent when the cover lid is placed on the container, so that a print ink can descend freely by the force of gravity from the ink conduit needle onto the porous ink-absorbent and from the porous ink-absorbent vertically down to the print head; and wherein said apparatus comprises:

a resilient septum;

a support for said septum; and a stall for receiving said print cartridge in a substantially horizontal direction so that said ink conduit needle horizontally pierces said septum.

* * * * *